US008950605B2

(12) United States Patent
Jene

(10) Patent No.: US 8,950,605 B2
(45) Date of Patent: Feb. 10, 2015

(54) MONITORING AND ALARM DEVICE FOR CONSTRUCTION MACHINERY

(75) Inventor: Thilo Jene, Spiesen (DE)

(73) Assignee: Terex Demag GmbH (DE)

( * ) Notice: Subject to any disclaimer, the term of this patent is extended or adjusted under 35 U.S.C. 154(b) by 158 days.

(21) Appl. No.: 13/205,130

(22) Filed: Aug. 8, 2011

(65) Prior Publication Data

US 2012/0037585 A1 Feb. 16, 2012

(30) Foreign Application Priority Data

Aug. 11, 2010 (DE) ..... 20 2010 011 345 U

(51) Int. Cl.
*B66C 15/00* (2006.01)
*B66C 23/90* (2006.01)
*B66C 13/16* (2006.01)

(52) U.S. Cl.
CPC ..... *B66C 23/905* (2013.01)
USPC ..... 212/276; 212/277; 212/280

(58) Field of Classification Search
USPC ..... 212/276, 277, 278, 279, 280, 281, 203
See application file for complete search history.

(56) References Cited

U.S. PATENT DOCUMENTS

| | | | | |
|---|---|---|---|---|
| 6,170,681 | B1 * | 1/2001 | Yoshimatsu | 212/278 |
| 6,535,116 | B1 * | 3/2003 | Zhou | 340/447 |
| 6,894,621 | B2 * | 5/2005 | Shaw | 340/685 |
| 2005/0224439 | A1 * | 10/2005 | Bean et al. | 212/280 |
| 2006/0028060 | A1 * | 2/2006 | Kuramochi et al. | 303/89 |
| 2008/0053945 | A1 * | 3/2008 | Schneider et al. | 212/276 |
| 2008/0217279 | A1 * | 9/2008 | Gelies et al. | 212/278 |
| 2009/0139947 | A1 * | 6/2009 | Harris et al. | 212/278 |
| 2009/0294746 | A1 * | 12/2009 | Heidrich et al. | 254/375 |

* cited by examiner

*Primary Examiner* — Sang Kim
*Assistant Examiner* — Nathaniel Adams
(74) *Attorney, Agent, or Firm* — Cantor Colburn LLP

(57) ABSTRACT

The invention relates to a monitoring and alarm device for construction machinery having long and heavy booms, such as cranes, in particular mobile cranes, is characterized in that a monitor system is provided, which monitors parameters that may change in case of an undesired lowering of the boom or of boom sections in a non-operating condition, and triggers an optical and/acoustic and/or wireless alarm system if the parameters change.

11 Claims, 1 Drawing Sheet

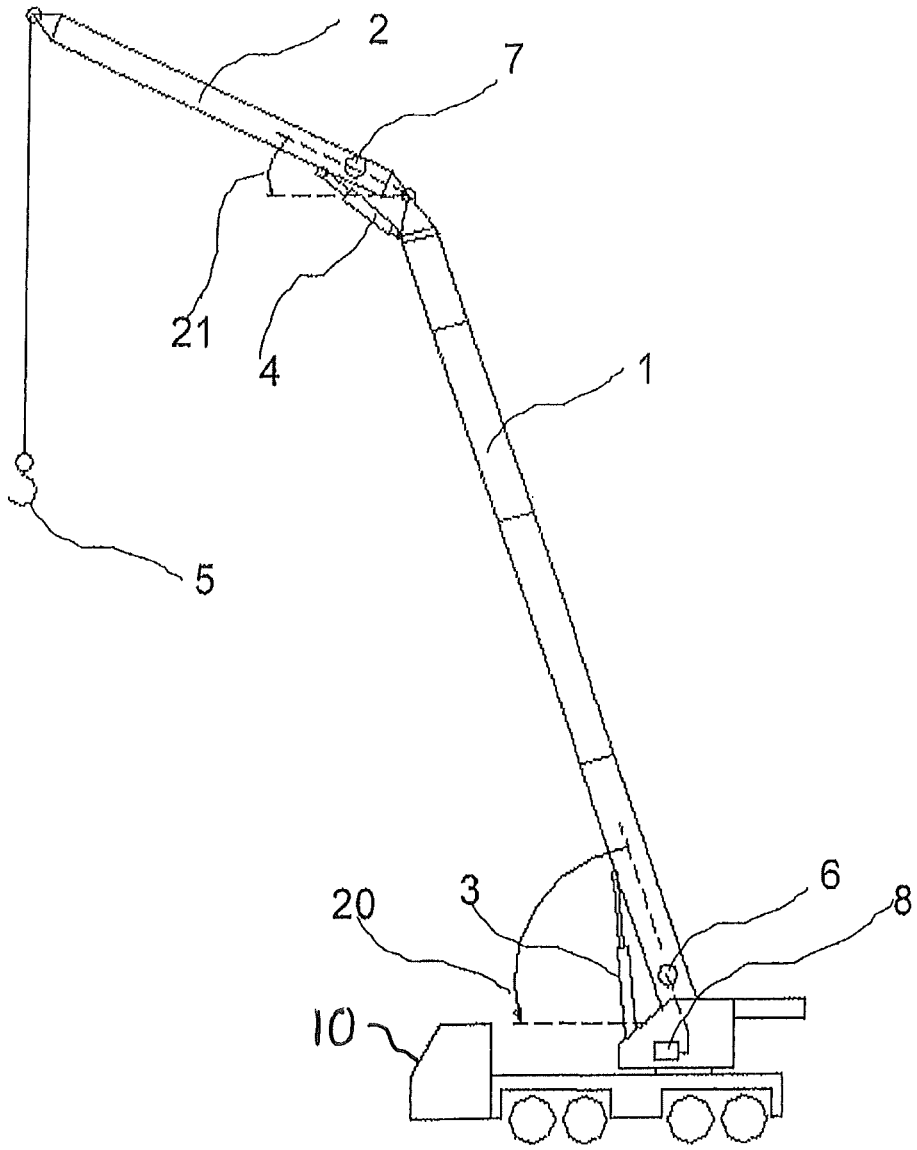
2
7
21
4
1
5
20
3
6
8
10

MONITORING AND ALARM DEVICE FOR CONSTRUCTION MACHINERY

CROSS REFERENCE TO RELATED APPLICATION

This application claims the benefit of German patent application No. 20 2010 011 345.8 Filed Aug. 11, 2010, the contents of which are incorporated in there entirety herein by reference thereto.

FIELD OF THE INVENTION

The invention relates to a monitoring and alarm device for construction machinery having long and heavy booms such as cranes and, in particular, mobile cranes.

BACKGROUND

Very slow dropping of the boom due to leakages can never be ruled out with absolute certainty when load-holding valves or check valves are used. This is hardly noticeable owing to the large oil volume in the luffing cylinders. If, due to the surrounding area and task, e.g. in narrow street canyons or refineries, the crane cannot be removed during prolonged downtimes, a minor leakage as a result of contamination, for example, causes the boom or part of the boom to drop. This may result in collisions with the surrounding area or tilting of the crane.

It has been known to provide one or more load-holding valves, which check the pressure in the luffing cylinder(s). Smaller construction vehicles, e.g. excavators, are usually provided with mechanical safety devices in order to prevent the boom from lowering due to leakages. U-shaped sleeves placed around the cylinder rods can be seen, for example, at construction vehicle fairs. Such sleeves would be too heavy and too difficult to handle for mobile cranes.

The object of the invention is to prevent accidents caused by very slow unnoticeable changes in the setup condition as a result, for example, of unnoticed lowering of booms or boom extensions, or unnoticed telescopically retracting booms or boom extensions, or unnoticeably retracting outrigger cylinders when the crane operator is not in the cabin and the crane is not in operational use.

SUMMARY

A monitoring and alarm device for construction machinery having long and heavy booms, such as cranes, in particular mobile cranes, characterized in that a monitor system is provided, which monitors parameters that may change in case of an undesired lowering of the boom or of boom sections in a non-operating condition, and triggers an optical and/acoustic and/or wireless alarm system if the parameters change.

The above features and advantages, and other features and advantages of the present invention are readily apparent from the following detailed description when taken in connection with the accompanying drawing.

BRIEF DESCRIPTION OF THE DRAWING

Other objects, features, advantages and details appear, by way of example only, in the following detailed description of the embodiments, the detailed description referring to the following drawing in which an exemplary embodiment of a mobile crane is illustrated embodying the invention.

DESCRIPTION OF THE EMBODIMENTS

The following description is merely exemplary in nature and is not intended to limit the present disclosure, its application or uses.

A monitoring and alarm device 8 for construction machinery having long and heavy booms, such as cranes, in particular mobile cranes 10, is characterized in that a monitor system is provided, which monitors parameters that may change in case of an undesired lowering of the boom or of boom sections 1 and 2 in a non-operating condition, and triggers an optical and/acoustic and/or wireless alarm system if the parameters change.

A monitoring of the parameters that change when the boom or boom sections 1 and 2 lower, is to take place according to the invention, since it has not been possible thus far to reliably prevent the boom from lowering due to leakages. These parameters are in particular the boom angles 20 and 21 and/or the hydraulic pressure in the luffing cylinder or cylinders 3 and 4, as well as the length of the boom sections 1 and 2.

It is also conceivable to monitor the cylinder lengths or geometries or positions.

If a tolerance field of the parameters is exceeded or falls short, a warning message is emitted by the crane control or by a separate monitoring system (not shown). This warning message can be directly emitted optically or acoustically by the crane 10 and can warn the immediately surrounding areas of the construction site and can also be communicated wirelessly or via SMS to a central location in order to allow an absent crane operator to return the crane 10 to the safe area.

The monitoring device or system 8 must function in particular if the crane 10 is not operating for a longer period of time, for example, during the night or over the weekend. For the purpose of not discharging the crane battery is made available A supply of the monitoring control system by means of an autonomous unit, A supply of the monitoring control system by means of separate batteries, A supply of the monitoring control system by means of a power supply line because the crane control, or at least parts thereof, must be active for monitoring.

Warning messages can be sent to qualified operating staff, for example, via wireless messages, SMS, optical signals, or acoustic signals.

The monitoring device is preferably used for load-bearing cylinders, such as those used, for example, in mobile cranes 10 for Luffing cylinders 3 of the main boom 1

Luffing cylinders 4 of adjustable boom extensions 2

Outrigger cylinders

Telescopic cylinders of main booms

Telescopic cylinders of telescopic boom extensions

Anchoring cylinders of boom anchors

In the non-operating condition, the monitoring device is preferably coupled to an already existing overload limiter and/or to a working range limiter, and the sensors, which are already available for load torque limitation and/or working range limitation, are used for monitoring purposes.

The already available input accesses of the crane control system can likewise be used for the input of tolerance limits and of parameters to be monitored.

Integration into a teleservice system, which informs a central location about the condition of the crane, such as, for example, operating hours, oil status, or utilization ratio, Such teleservice systems are prior art, as are also the signal transmission options which can then also be used for monitoring. The warning message to the construction site or to the crane operator is then issued by the central location.

The tolerance limits until the warning message is triggered can be defined by the crane operator in adaptation to the respective situation.

The tolerance limits until the emission of a warning message can conveniently be predefined in that the crane operator approaches a tolerance limit by actuating the crane and confirms this in the monitoring control system. The procedure is comparable to the limitation of a working range.

The tolerance limits until a warning message is emitted can be entered as numerical values of the parameters to be monitored, the tolerance limits can be fixed, but are dependent upon the respective setup condition.

The tolerance limits until a warning message is emitted can be generated by an operations planning tool, in particular a computer-assisted operations planner.

Such crane operation planners are prior art and are used for the preliminary simulation of a crane operation.

The warning message can distinguish different degrees of urgency, so that only the crane driver is alerted in a first instance, and area surrounding the crane in a second instance.

The system already available in the crane 10 for limiting the load torque can be used as a measuring system, or an additional system can be used exclusively or in part for the monitoring.

Monitoring can be carried out by means of a GPS system (not shown) which detects the position of the crane components and/or the changes thereof. GPS units, via which changes in position can be detected, are attached for this purpose to the mobile crane parts.

Monitoring can be carried out by means of optical sensors (not shown) or camera systems (not shown).

Parts of the crane control can be shut off and reduced to the minimum required for monitoring the setup state in the monitoring mode. The crane battery is less strained as a result of this.

The monitoring system 8 can also comprise a hydraulic backfeed, which prevents the drainage of the cylinders 3 and 4 in case of sagging. If load-holding winches are monitored, the motor is prevented from cavitating by the backfeed and/or by the installation of a hydraulic bridge between both pressure connections of the winch motor in case of lowering.

The monitoring device can be permanently activated or be manually activated and/or deactivated by the crane driver, or can also be automatically activated when the crane is shut off.

The monitoring parameters can be transmitted to other construction machinery, in particular cranes, and can have an influence on known anti-collision controls therein. They usually only comprise of fixed geometries of non-operating cranes, but not unintentional movements. An unintentional movement of a non-operating crane as a consequence of a lowering of boom sections could thus result in the failure of the anti-collision controls of other cranes.

The monitoring system 8 can also monitor the setup condition of the crane 10 while the crane is in operation, but no if a crane movement is actuated by the crane operator. Possible unintentional crane movements due to leakages are thus detected before the crane is shut down.

The parameters can be monitored continuously as well as at discrete times by retrieving the parameters after predefined time intervals and comparing them to the parameters stored at the beginning of the monitoring process. The monitoring means can be on standby energy-saving mode between the discrete times.

The advantages of the invention are an increased safety of non-operating mobile cranes and/or of the surrounding area of the rigged cranes. A permanent presence of the crane operator at the control console is additionally not necessary during prolonged downtimes of the crane 10.

During operation, crane operator activates the monitoring system before leaving the crane 10 if the crane is shut down in rigged condition and is expected to remain in this position without the presence of a crane operator at the control console of the crane for a prolonged period of time.

The monitoring system subsequently stores the angles 20 of the crane boom 1 as well as the angles 21 of the auxiliary boom 2 measured by the angle sensors 6 and/or 7, and/or the electronics of the monitoring system 8.

The crane operator can input tolerance limits for different parameters until the emission of a warning message. After leaving the crane, the monitoring device 8 remains active; all control functions that are not required for this purpose as well as the drive units are shut off.

If the tolerance limits for one or more parameters are now exceeded, because the crane components 1 and/or 2 are lowering due to changes in the angles 21 and/or 22 caused by leakages from the cylinders 3 and/or 4, partial systems of the crane control are booted and warning messages are issued. This can take place, for example, in the form of an SMS, which is transmitted to the crane operator. The crane operator can stay, for example, in a sleeping container, which is common at large construction sites, and reach the crane 10 with enough time to prevent the dangerous situation by starting and controlling the crane. The construction site can furthermore be alerted by means of acoustic and/or optical warning signals, which can either originate directly at the crane or at a central location, which is then in turn activated by means of a signal originating at the crane, e.g. wirelessly.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the present application.

The invention claimed is:

1. A crane comprising:

a base;

a main boom coupled to the base, wherein the main boom is angled at a first boom angle;

a boom extension rotatably coupled to an end of the main boom, wherein the boom extension is angled at a second boom angle;

a first luffing cylinder coupled to the main boom to adjust the first boom angle;

a second luffing cylinder coupled to the boom extension to adjust the second boom angle;

a crane control system configured to move the main boom and the boom extension;

an unintentional boom movement detection system configured to detect unintentional movement of the main boom and/or the boom extension due to hydraulic leakage of the first and/or second luffing cylinder, wherein the unintentional boom movement detection system comprises:

a main boom angle sensor configured to measure the first boom angle;

a boom extension angle sensor configured to measure the second boom angle;

a first hydraulic leakage sensor coupled to the first luffing cylinder, the first hydraulic leakage sensor configured to measure the hydraulic pressure in the first luffing cylinder;

a second hydraulic leakage sensor coupled to the second luffing cylinder, the second hydraulic leakage sensor configured to measure the hydraulic pressure in the second luffing cylinder, wherein the unintentional boom movement detection system monitors and determines, when the crane and crane control system are shut off and not in an operational state, a change in the first boom angle, the second boom angle, the hydraulic pressure in the first luffing cylinder, and the hydraulic pressure in the second luffing cylinder;

an alarm system operatively coupled to the unintentional boom movement detection system, wherein when the unintentional boom movement detection system determines that a change in the first boom angle, the second boom angle, the hydraulic pressure in the first luffing cylinder, and/or the hydraulic pressure in the second luffing cylinder exceeds a predefined tolerance limit that indicates a hydraulic leakage in the crane resulting in an undesired lowering of the main boom and/or the boom extension, the alarm system turns on at least a portion of the crane control system and generates a warning signal.

2. The crane of claim 1, wherein the main boom further comprises first telescopic cylinders and the boom extension further comprises second telescopic cylinders, wherein the unintentional boom movement detection system further comprises:

a third hydraulic leakage sensor coupled to the first telescopic cylinders, the third hydraulic leakage sensor configured to measure the hydraulic pressure in the first telescopic cylinders; and a fourth hydraulic leakage sensor coupled to the second telescopic cylinders, the fourth hydraulic leakage sensor configured to measure the hydraulic pressure in the second telescopic cylinders, wherein the unintentional boom movement detection system further monitors and determines a change in the hydraulic pressure in the first telescopic cylinders and the hydraulic pressure in the second telescopic cylinders, wherein the alarm system generates the warning signal when the unintentional boom movement detection system determines that a change in the hydraulic pressure in the first telescopic cylinders and/or the hydraulic pressure in the second telescopic cylinders exceeds a predefined tolerance limit, the warning signal triggering at least one of an optical alarm, an acoustic alarm, and a wireless alarm signal.

3. The crane of claim 1, further comprising a GPS system, which detects a change in the position of the main boom, the boom extension, the first luffing cylinder, and the second luffing cylinder, wherein the alarm system generates the warning message when the change in position exceeds a predefined tolerance limit.

4. The crane of claim 1, wherein the unintentional boom movement detection system is automatically activated when the crane is shut-off.

5. The crane of claim 1, wherein the unintentional boom movement detection system and the alarm system are connected to at least one of an autonomous unit that generates electricity, batteries, and a power supply line, to reduce power usage from a main crane battery.

6. The crane of claim 1, wherein the unintentional boom movement detection system is connected to at least one of an overload limiter of the crane and a working range limiter of the crane, the unintentional boom movement detection system communicatively coupled to at least one of a sensor of the overload limiter for determining a load torque limitation and to a sensor of the working range limiter for determining a working range limitation, wherein an input access of the crane control system of the crane can be used for input of the predefined tolerance limits.

7. The crane of claim 1, wherein the warning signal is transmitted to anti-collision controls of other construction machinery.

8. The crane of claim 1, wherein the alarm system is connected to a teleservice system, which informs a central location when the predefined tolerance limit is exceeded.

9. The crane of claim 1, wherein the unintentional boom movement detection system further comprises:

a main boom length sensor configured to measure a length of the main boom; and a boom extension length sensor configured to measure a length of the boom extension.

10. A method of monitoring a crane with a monitoring and alarm device, the crane comprising a main boom, a boom extension, a first luffing cylinder coupled to the main boom, and a second luffing cylinder coupled to the boom extension, the method comprising:

shutting off the crane;

when the crane is shut off, monitoring parameters with the monitoring and alarm device including a first boom angle of the main boom, a second angle of the boom extension, a hydraulic pressure of the first luffing cylinder, and a hydraulic pressure of the second luffing cylinder, which parameters change during unintentional movement and an undesired lowering of the main boom or the boom extension, wherein changes of the parameters indicate a hydraulic leakage in the crane;

when the crane is shut off, issuing an alarm signal with the monitoring and alarm device when the monitored parameters change and exceed a predetermined tolerance limit; and triggering, with the alarm signal, at least one of an optical, an acoustic, and a wireless alarm.

11. The method of claim 10, wherein said monitoring parameters comprises monitoring a change in length of first telescopic cylinders of the main boom and second telescopic cylinders of the boom extension that can change during an undesired lowering of the at least one boom section when the crane is shut off.

* * * * *